US005175576A

United States Patent [19]

Lancaster

[11] Patent Number: 5,175,576

[45] Date of Patent: Dec. 29, 1992

[54] METHOD AND APPARATUS FOR ATTACHING A FILM CONTAINER TO A CAMERA STRAP

[76] Inventor: Robert S. Lancaster, 6400 SW. Parkhill Way, Portland, Oreg. 97201

[21] Appl. No.: 792,032

[22] Filed: Nov. 13, 1991

[51] Int. Cl.[5] ..... G03B 19/00

[52] U.S. Cl. ..... 354/354; 224/252

[58] Field of Search ..... 354/275, 354; 224/908, 224/252, 253

[56] References Cited

U.S. PATENT DOCUMENTS

| | | | |
|---|---|---|---|
| 1,589,315 | 6/1926 | Johnston | 224/908 |
| 4,406,385 | 9/1983 | Pribyl | 224/908 |
| 5,065,918 | 11/1991 | Chun et al. | 224/252 |

*Primary Examiner*—Michael L. Gellner
*Assistant Examiner*—David M. Gray
*Attorney, Agent, or Firm*—Klarquist, Sparkman, Campbell, Leigh & Whinston

[57] ABSTRACT

An apparatus for attaching a film container to a camera strap is provided. The apparatus includes an elongated base, a mount for coupling the base to the camera strap and a receptacle for holding film that is attached to the base. The base may be mounted to the camera strap by the attachment of a snap fastener at each end of the base. The ends are positioned around the strap and are detachably coupled together to mount the base to the strap. The receptacle may take the form of an elastic loop that is sized to hold at least one container of film and is secured to the center portion of the base.

13 Claims, 1 Drawing Sheet

Fig. 1
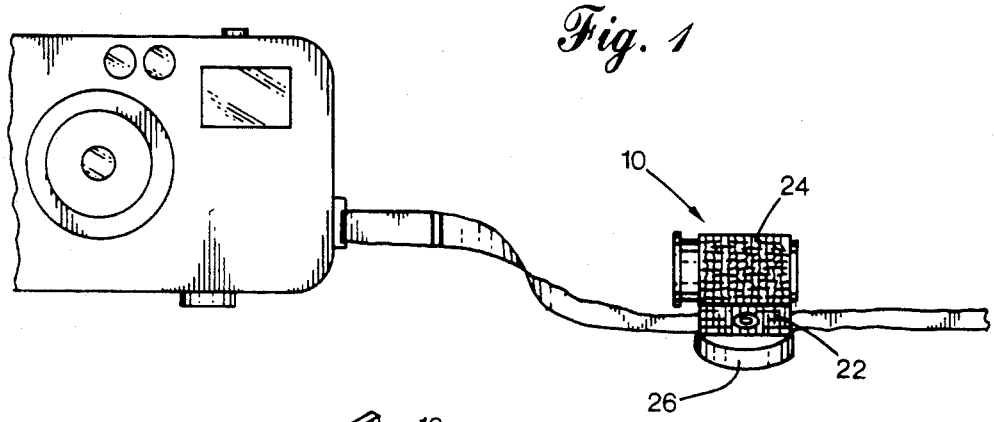
Fig. 2
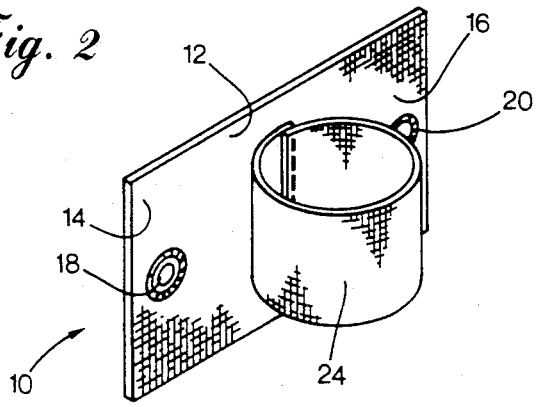
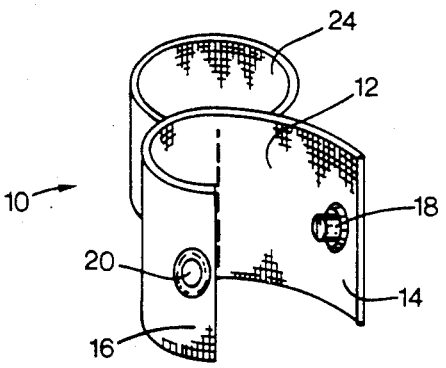
Fig. 3
Fig. 4
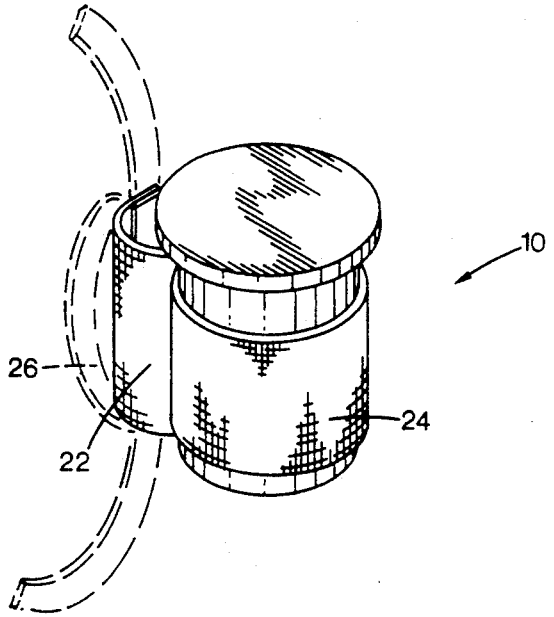

METHOD AND APPARATUS FOR ATTACHING A FILM CONTAINER TO A CAMERA STRAP

BACKGROUND OF THE INVENTION

1. Field of the Invention

The present invention relates to a method and apparatus for attaching a film container to a camera strap.

2. Description of the Prior Art

It is convenient and efficient for a photographer to have easy access to several film containers while taking pictures. Storing such containers in a camera bag requires the photographer to carry extra baggage, when it may not be otherwise necessary, and is also cumbersome when the photographer needs to change film quickly.

Products that allow the user to attach a film container to a camera strap are known. The prior art includes a camera strap with an elastic band sewn into the underside of one of its ends. This elastic band is fastened at its ends to the strap and stitched to the camera strap in two spaced-apart intermediate locations to provide three pockets in which to store film containers. This device is bulky and uncomfortable as the film containers rest against the photographer's body. Furthermore, this device requires the replacement of a standard camera strap with a specialized strap, thereby adding to a photographers' cost and wasting resources.

A vinyl film container, sized to accommodate a standard size film canister, is also known in the art. A rigid vinyl loop is positioned at the exterior of the container. The photographer slides the strap through the loop to attach the container to the strap. In this case, the container cannot readily be removed from the strap, particularly when the strap is supporting a camera around a user's neck.

Another known film container is molded from plastic and includes two sets of rigid projecting flanges which are each undercut to form a groove with the flanges each set being spaced apart a narrow distance (approximately ½ inch to ¾ inch). The respective sets of flanges define portions of a strap receiving channel. The container is attached to the strap by pressing the strap edges underneath the undercut flanges. This container can only be attached to a strap of a width which is very close to the width of the spacing of the grooves. The film container of this design would also tend to separate from the strap if subjected to impact.

Accordingly, the need exists for an apparatus that will allow a photographer to easily and conveniently attach a film container to camera straps of varying size.

SUMMARY OF THE INVENTION

The present invention provides an improved apparatus for attaching a film container to a camera strap. The apparatus includes a base, a mount for coupling the base to a camera strap and a receptacle mounted to the base that is sized to receive at least one film container.

The base may be of any size, shape or material suitable for attachment to a camera strap. It is preferred that the base be of an elastic material and of sufficient size to surround the strap so that the base may be detachably coupled to the strap by fastening one end of the base to another. A snap fastener is a particularly preferred mount, as it permits the ends of the base to be easily attached to and detached from one another.

A film receptacle is mounted on or coupled to the base. The receptacle is appropriately sized to receive and securely hold at least one film container. This receptacle is preferably constructed from an elastic material and is in the form of a loop.

The present invention also includes a method for attaching a film container to a camera strap wherein the film container is inserted into a receptacle, mounted on a base. The base is positioned around a camera strap and secured thereto. When the camera strap is not of sufficient width to accommodate the base, the user may form a loop in the strap. The base is positioned around this loop and secured thereto.

These and other advantages, features and objects of the present invention will become apparent from the description of the preferred embodiments hereinbelow.

BRIEF DESCRIPTION OF THE DRAWINGS

In order that the present invention may be clearly understood and readily practiced, preferred embodiments will now be described, by way of example only, with reference to the accompanying figures wherein:

FIG. 1 represents a side view showing one method of attaching the apparatus of the present invention to a camera strap;

FIG. 2 represents a perspective view of the apparatus of the present invention;

FIG. 3 represents an end view of the apparatus of the present invention; and FIG. 4 represents a perspective view showing one method of attaching the apparatus of the present invention to a camera strap.

DETAILED DESCRIPTION OF THE PREFERRED EMBODIMENTS

A preferred embodiment of the apparatus of the present invention is shown in FIG. 2. The apparatus 10 includes an elongated base 12 having a first end 14 and a second end 16. Base 12 is preferably made of a flexible material, most preferably elastic, that has been heat treated to reduce or eliminate fraying. An elastic material is one that is capable of being stretched at least in one direction at least about twenty percent and of returning to substantially its original size after being stretched.

Base 12 is of sufficient length to surround the width of a camera strap so that first end 14 and second end 16 may be positioned in proximity to one another with the strap between them. It is preferred to have a base of sufficient length so that end 14 and end 16 may be positioned in an overlapping relationship. It has been found that a base that is three inches in length is suitable for use with standard camera straps. It will be appreciated that the base may be constructed to be of any desired length to accommodate a variety of camera straps. The base may be constructed of any suitable material, rigid or flexible, that is capable of being mounted to a camera strap. For example, the base may be constructed of a rigid plastic or of a flexible cord which are of sufficient length to surround a camera strap.

Apparatus 10 includes a mount for detachably coupling base 12 to the camera strap. A variety of mounting means may be used, depending upon the type of material used to construct the base. In the preferred embodiment wherein the base is of a flexible material, the preferred mount is a conventional two-part snap fastener consisting of a snap 18 located at first end 14 of base 12 and a corresponding snap receiving portion 20 located at second end 16 of base 12. The snap fastener is used to couple the first end 14 to the second end 16 which are positioned in an overlapping relationship. Snap fasteners are easy to use and provide secure attachment in comparison to fastener mechanisms such as Velcro. However, any fastening means, such as Velcro or a hook or button/buttonhole or loop arrangement, or combinations of fastening mechanisms, that will permit the ends of the base to be detachably coupled to one another may be used. Thus, first end 14 is detachably coupled to second end 16, thereby mounting base 12 to the camera strap. The base thereby forms an elastic loop 22, best seen in FIGS. 1 and 4, for receiving the camera strap.

A receptacle for holding the film container is mounted to base 12. Base 12 is preferably of sufficient width to support this receptacle. A suitable width is 1-½ inches, although it will be appreciated that the width of base 12 may vary, for example, depending upon the and shape of the receptacle. The receptacle is sized to receive and securely hold at least one film container.

As best shown in FIGS. 2 and 3, it is preferred for the receptacle to be of a flexible elastic material, which may be formed into a loop 24. As loop 18 is elastic, it will conform to the shape of the film container to securely hold the container in place. Loop 24 may be mounted on base 12 by a variety of available mounting means. It is preferred to mount loop 24 onto base 12 by stitching it to the center portion of base 12. Alternatively, a film container with a cap or lid may be directly mounted to the base to serve as the receptacle. The film and/or film container is then deposited into the receptacle itself.

When the camera strap is of sufficient width, base 12 may be wrapped around and secured to the camera strap by fastening ends 14 and 16 together using a snap fastener as described above. The base, due to its elasticity, contracts and grips the camera strap to minimize sliding of the base on the camera strap. The film container is easily inserted into or removed from loop 24 as needed.

A narrow camera strap may not be wide enough to be gripped by the base 12 in the manner described above. In this instance, the user may form a loop 26 in the camera strap, as best seen in FIGS. 1 and 4. Base 12 is then positioned around and secured to loop 26 via snap fastening portions 18 and 20 as described above. The loop in the camera strap in combination with the base prevents the base from sliding along the camera strap.

While the present invention has been described in connection with preferred embodiments, it will be understood that modifications and variations apparent to those of ordinary skill in the art are within the scope of the present invention. I claim as my invention all such modifications which fall within the scope of the following claims.

What is claimed is:

1. An apparatus for attaching a film container to a camera strap, the container having a top, a bottom and a sidewall which may be of a circular cross section, the apparatus comprising:

an elongated base having first and second ends;

a mount for coupling the base to the camera strap; and a receptacle of a flexible elastic material in the form of a loop that is mounted to the base and sized for receiving at least one film container, the loop and base together forming an enclosure which completely surrounds the film container sidewall.

2. An apparatus according to claim 1 in which the base is of a flexible material, the base being sized to surround the camera strap with the first and second ends of the base positioned in proximity to and overlapping one another and the mounted comprising a fastener for detachably coupling the first end of the base to the second end of the base to thereby mount the base to the camera strap.

3. An apparatus according to claim 2 in which the base is sized to surround the camera strap with the first and second ends of the base positioned in an overlapping relationship, the fastener comprising a snap fastener for detachably coupling the first end of the base to the second end of the base.

4. An apparatus for attaching a film container to a camera strap comprising:

an elongated base of an elastic material having a first end and a second end, the base being of sufficient length to surround a camera strap;

a snap fastener located at the first and second ends of the base for detachably coupling the first end of the base to the second end of the base in an overlapping relationship while surrounding the camera strap; and a loop of an elastic material, sized to receive a film container, stitched to the center portion of the base.

5. An apparatus for attaching a film container to a camera strap comprising:

a base of a flexible elastic material, the base having a first end and a second end and a film container receptacle, the base having a sufficient length to surround the camera strap; and a fastener for securing the first end of the base to the second end of the base with the strap surrounded by the base.

6. An apparatus for attaching a film container to a camera strap as recited in claim 5 wherein the receptacle comprises a loop of a flexible material mounted to the base.

7. An apparatus for attaching a film container to a camera strap as recited in claim 6 wherein the loop is of an elastic material.

8. An apparatus for attaching a film container to a camera strap as recited in claim 5 wherein the fastener comprises a snap fastener.

9. An apparatus according to claim 5 in which the film container receptacle is continuously open at least at one end for receiving a film container.

10. An apparatus according to claim 5 in which the film container receptacle is a closed loop which completely surrounds the film container.

11. An apparatus for attaching a film container to a camera strap comprising:

a base of an elastic material having a first end and a second end;

a receptacle for receiving the film container in the form of a loop of an elastic material mounted to the base;

a fastener for securing the first end of the base to the second end of the base such that upon securing the first end of the base to the second end of the base, the base forms a second elastic loop for receiving the camera strap therein.

12. A method of attaching a film container to a camera strap comprising the steps of:

providing a continuously open receptacle mounted on a base, the base having a first and a second end;

inserting the film container into the receptacle;

wrapping the base around a camera strap with the first and second ends of the base overlapping one another;

fastening the overlapping first and second ends of the base to secure the base around the strap.

13. A method for attaching a film container including the steps of:

forming a loop in the camera strap;

positioning the base around the loop in the camera strap; and fastening the first end of the base to the second end of the base to secure the base around the loop in the camera strap.

* * * * *